US006364411B1

(12) United States Patent
Zheng

(10) Patent No.: US 6,364,411 B1
(45) Date of Patent: Apr. 2, 2002

(54) FOLDABLE CHAIR WITH UTILITY SIDE DESK

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 0 days.

(21) Appl. No.: 09/738,499

(22) Filed: Dec. 18, 2000

(51) Int. Cl.[7] ..... A47C 4/38

(52) U.S. Cl. ..... 297/173; 297/16.2; 297/170; 297/135

(58) Field of Search ..... 297/16.2, 45, 135, 297/144, 170, 173

(56) References Cited

U.S. PATENT DOCUMENTS 2,447,391 A * 8/1948 Brandes ..... 297/135 X
5,685,602 A * 11/1997 Williams ..... 297/173 X
5,873,624 A * 2/1999 Simpson ..... 297/45
5,876,093 A * 3/1999 Williams ..... 297/173 X

* cited by examiner

*Primary Examiner*—Peter R. Brown
(74) *Attorney, Agent, or Firm*—Raymond Y. Chan; David and Raymond Patent Group

(57) ABSTRACT

A foldable chair equipped with a utility side desk, which includes a seat frame and a desk frame foldably coupled with the seat frame, wherein the desk frame includes a pair of supporting arms pivotally connecting with a second front and back frame legs of the seat frame respectively, a pair of slider joints for pivotally coupling two inner ends of said two supporting arms with a first front and back frame legs of the seat frame, and a pair of pivot arms which are extending sidewardly from the seat frame pivotally coupling with two outer ends of the two supporting arms respectively. Therefore, the utility side desk is capable of serving as an extra side surface, which is adapted to be quickly and easily folded with the foldable chair into a compact unit for carriage and storage and unfolded for use.

11 Claims, 10 Drawing Sheets

FOLDABLE CHAIR WITH UTILITY SIDE DESK

BACKGROUND OF THE PRESENT INVENTION

1. Field of Invention

The present invention relates to a foldable chair, and more particularly to a foldable chair equipped with a utility side desk which is foldably and outwardly extended from the foldable chair and serves as an extra side surface, wherein the foldable chair can be quickly and easily folded into a compact unit for carriage and storage and unfolded for use.

2. Description of Related Arts

Referring to FIG. 1 of the drawings, a conventional portable chair comprises a foldable chair frame constructed by metal tubes and a chair seat B1 made of durable fabric. The foldable chair frame A1 comprises a plurality of construction tubes A11 to construct a back frame A2 and a seat frame A3 for supporting the chair seat B1. The seat frame A1 comprises a front pair, a back pair and two side pairs of the construction tubes, wherein each pair of the construction tubes are pivotally connected together where they cross so that the chair frame A1 can be easily unfolded to provide a rigid cross-support for use and be folded up for storage.

Since such a conventional foldable chair can be easily and quickly unfolded for use and folded into a compact for carriage, a user can carry the foldable chair to everywhere such as campground or beach. However, the user may merely carry an extra foldable table in such a manner that the user can put his or her accessories such as drinks or magazines on the foldable table. It is inconvenience that the user has to carry one more item which is the foldable table to everywhere. Moreover, it is unreasonable that the user must purchase the extra foldable table just only equipped with the foldable chair.

SUMMARY OF THE PRESENT INVENTION

A main object of the present invention is to provide a foldable chair equipped with utility side desk which is foldably and outwardly from the foldable chair such that a user is able to put his or her accessories on the side desk.

Another object of the present invention is to provide a foldable chair with utility side desk, wherein the foldable chair can be quickly and easily folded into a compact unit for carriage and storage and unfolded for use.

Another object of the present invention is to provide a foldable chair with utility side desk which does not altering or complicating the original structural design of the chair frame of the foldable chair.

Another object of the present invention is to provide a foldable chair with utility side desk, wherein the structure of the side desk can be altered as a side pocket or a leg rest support arrangement according to the need of the user.

Accordingly, in order to accomplish the above objects, the present invention provides a foldable chair comprising a seat frame constructed to support a fabric seat thereon and a side desk frame for supporting a desk fabric thereon foldably and outwardly extended from the seat frame, wherein the seat frame comprises:

a pair of first and second front frame legs pivotally connected with each other in cross manner to form a "X" structure;

a pair of first and second back frame legs pivotally connected with each other in cross manner to form a "X" structure;

two pairs of side frame legs, each pair comprising a first side crossed leg and a second side crossed leg pivotally connected with each other in a cross manner to form a pivotal "X" structure;

a pair of front lower frame joints for pivotally connecting two lower ends of the two front frame legs with two lower front ends of the side frame legs respectively;

a pair of back lower frame joints for pivotally connecting two lower ends of the two back frame legs with two lower back ends of the side frame legs respectively;

a pair of front frame joints for pivotally connecting two upper ends of the two front frame legs with two upper front ends of the side frame legs respectively;

a pair of back upper frame joints for pivotally connecting two upper ends of the two back frame legs with two upper back ends of the side frame legs respectively; and the side desk frame comprising a pair of foldable supporting arms pivotally connecting with the second front and back frame legs respectively, a pair of slider joints for pivotally coupling two inner ends of the two supporting arms with the first front and back frame legs, and a pair of pivot arms which are extending outwardly from the seat frame pivotally coupling with two outer ends of the two supporting arms respectively.

DETAILED DESCRIPTION OF THE PREFERRED EMBODIMENT

Figure 1:
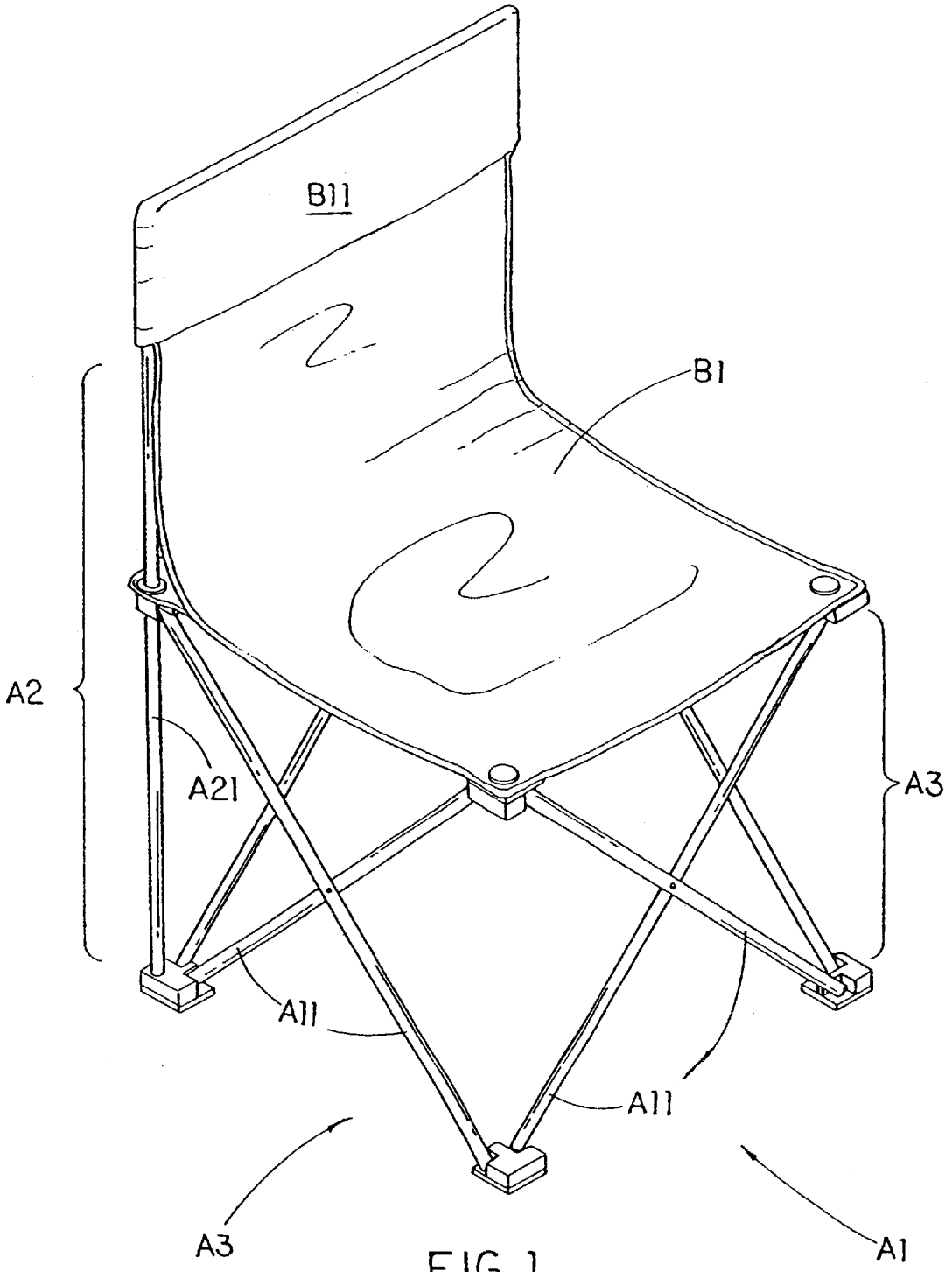
FIG. 1 PRIOR ART
FIG. 1 is a perspective view of a convention foldable chair.
Figure 2:
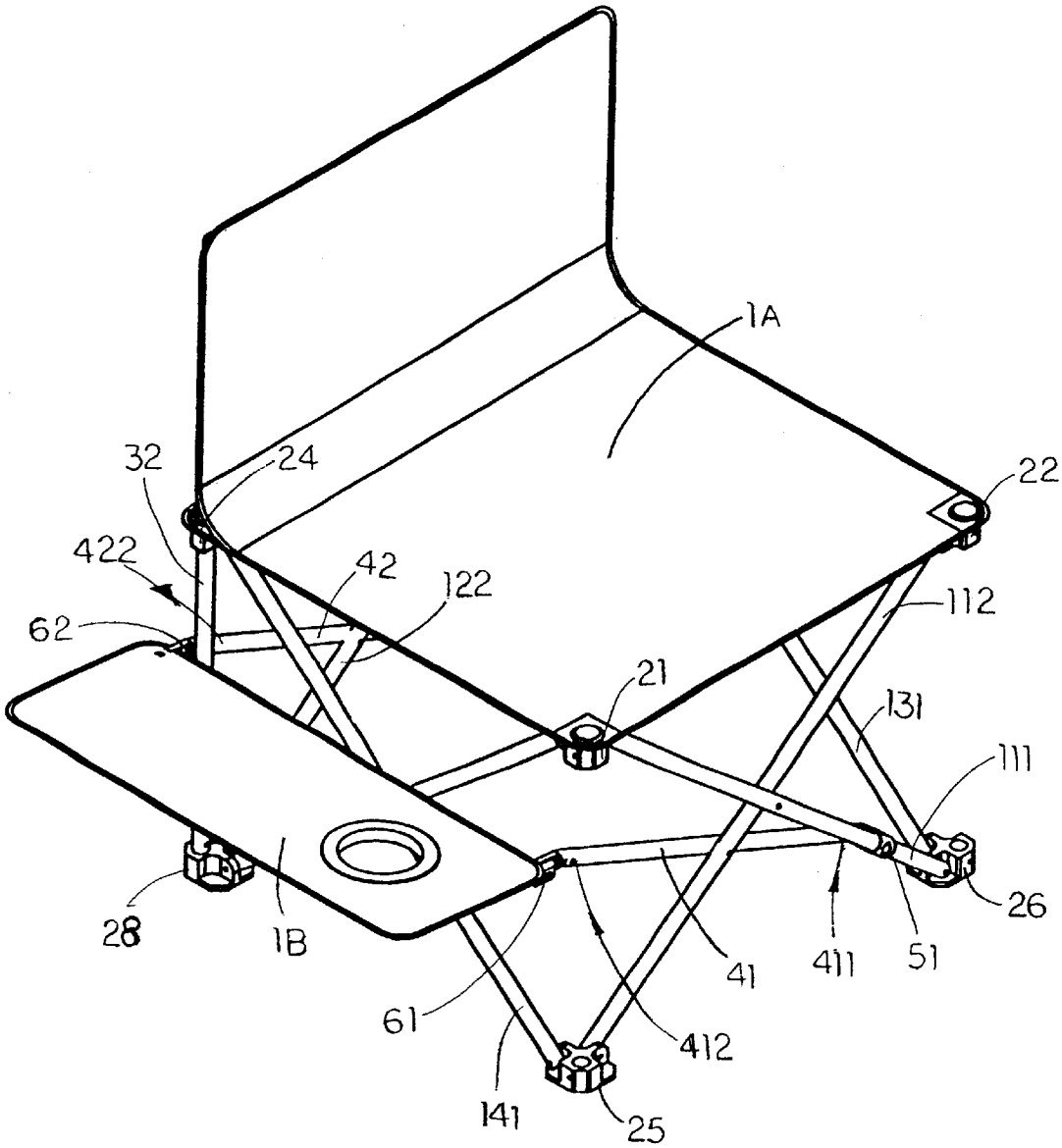
FIG. 2 is a perspective view of a foldable chair with utility side desk according to a preferred embodiment of the present invention.
Figure 3:
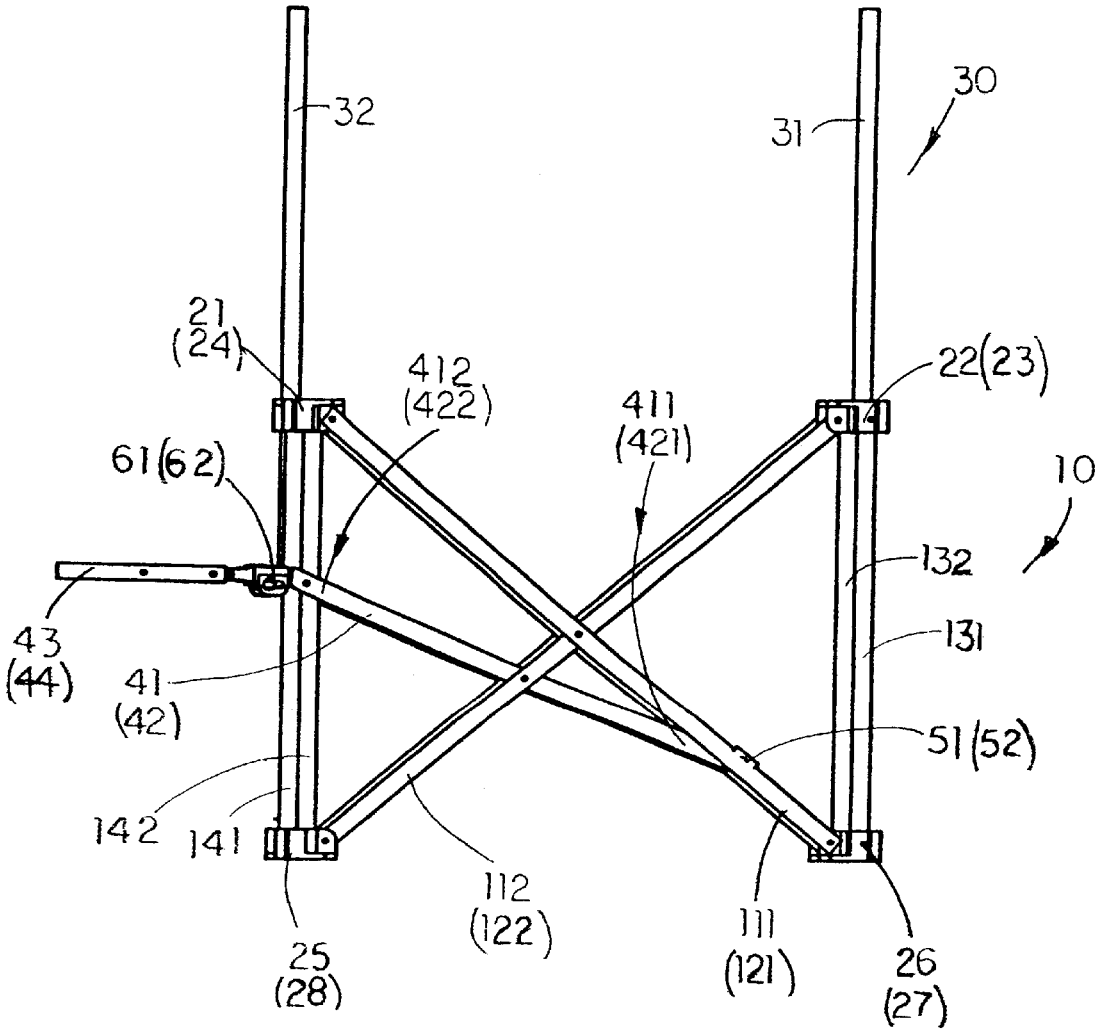
FIG. 3 is a front view of the foldable chair according to the above preferred embodiment of the present invention.
Figure 4:
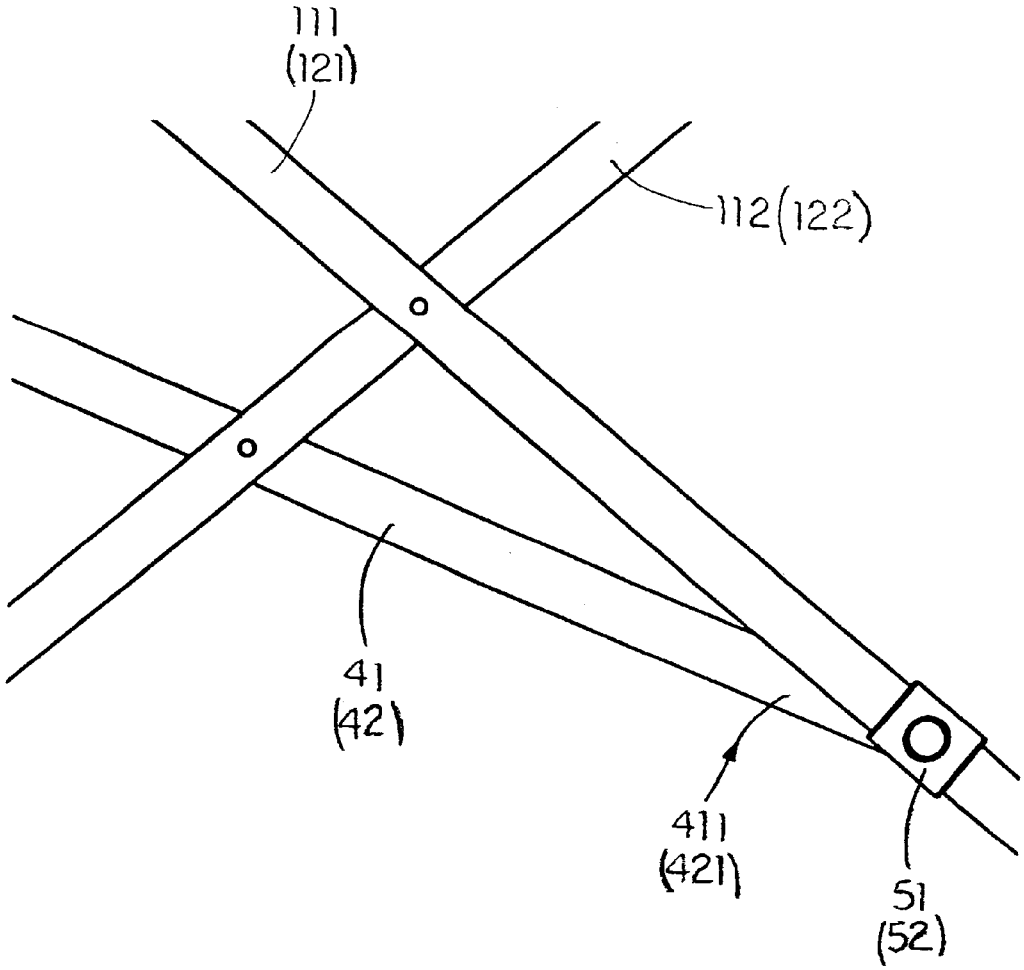
FIG. 4 is a partially front view of the foldable chair according to the above preferred embodiment of the present invention.
Figure 5:
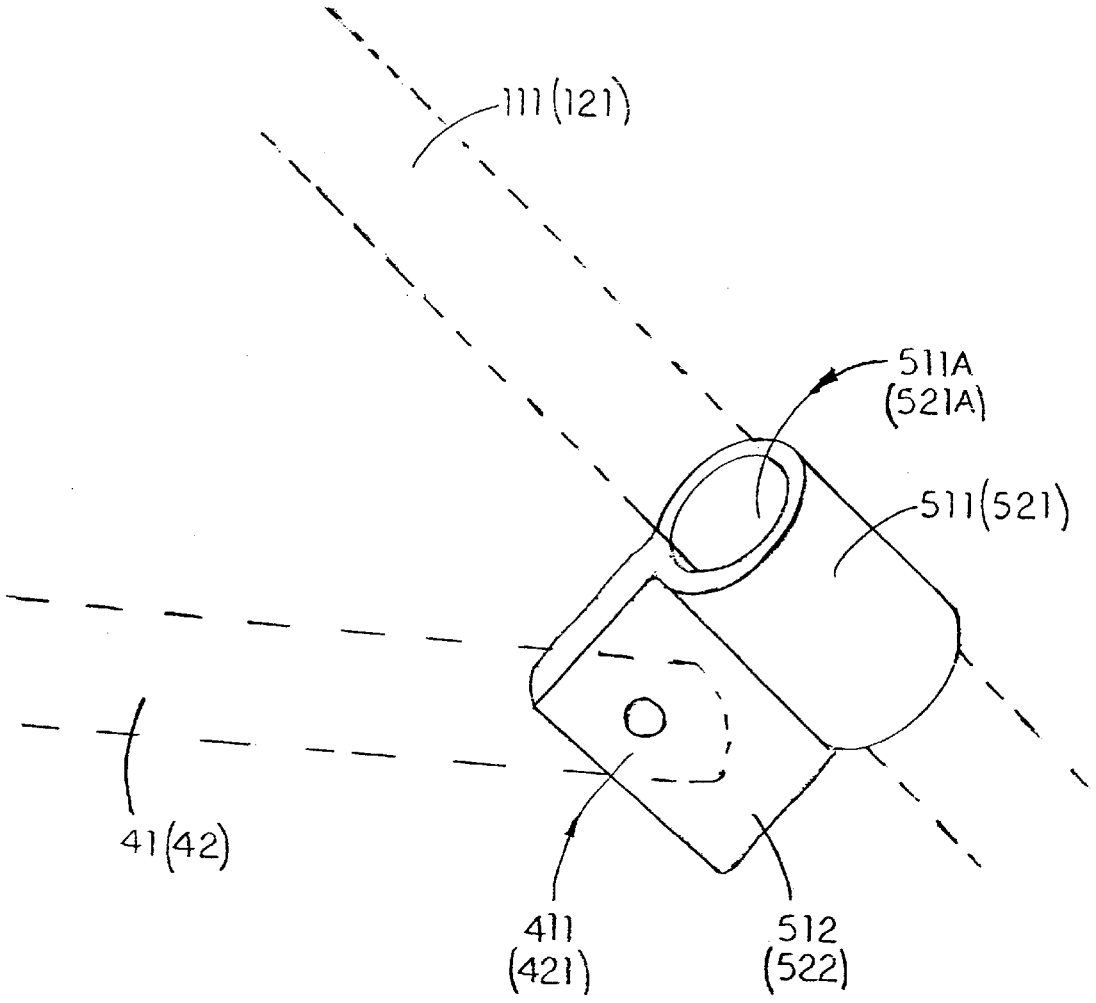
FIG. 5 is a perspective view of the slider joint of the foldable chair according to the above preferred embodiment of the present invention.
Figure 6:
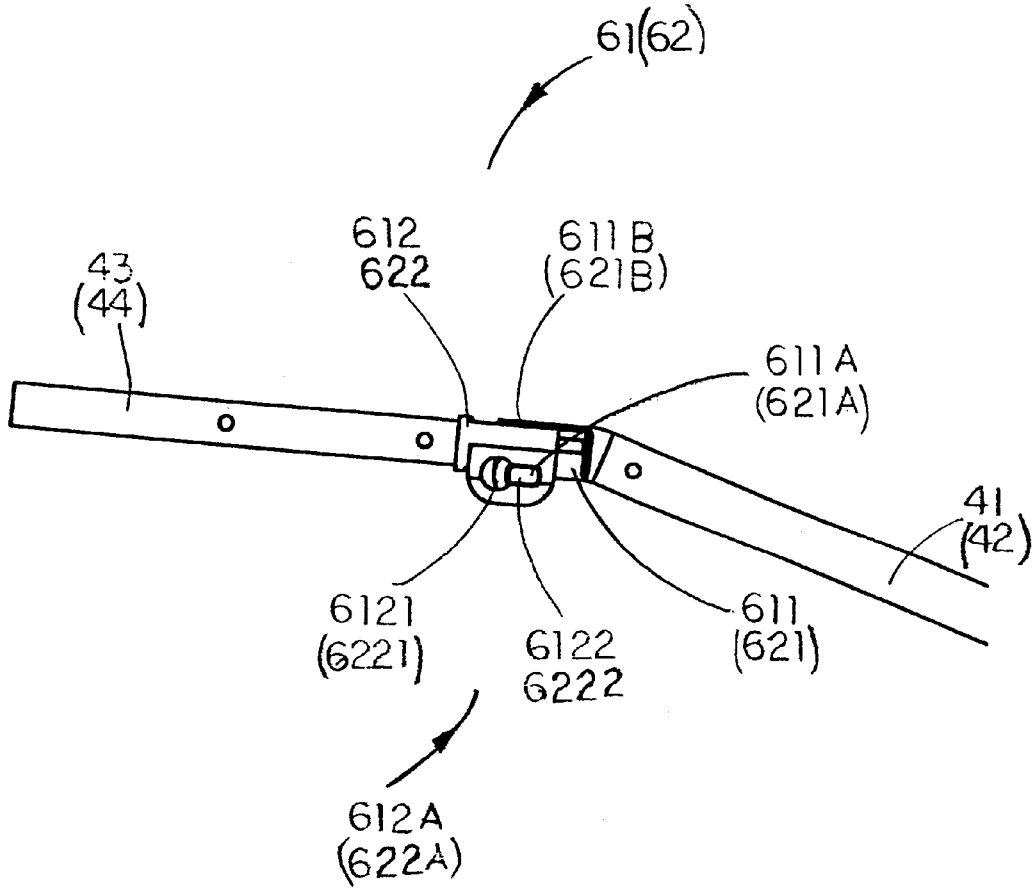
FIG. 6 is a partially front view of the support coupling means of the foldable chair according to the above preferred embodiment of the present invention.

Referring to FIGS. 2 and 3 of the drawings, a foldable chair with utility a side desk according to a preferred embodiment of the present invention is illustrated. The foldable chair comprises a seat frame 10 and a back frame 30 constructed to support a fabric seat 1A thereon.

The seat frame 10 comprises a pair of first and second front frame legs 111, 112 pivotally connected with each other in cross manner to form a "X" structure, a pair of first and second back frame legs 121, 122 pivotally connected with each other in cross manner to form a "X" structure, and two pairs of side frame legs 13, 14, each pair comprising a first side crossed leg 131, 141 and a second side crossed leg 132, 142 pivotally connected with each other in a cross manner to form a pivotal "X" structure.

The seat frame 10 further comprises a pair of front frame joints 21, 22, a pair of back frame joints 23, 24, a pair of front lower frame joints 25, 26, and a pair of back lower frame joints 27, 28.

The pair of front upper frame joints 21, 22 are adapted for pivotally connecting two upper ends of the two front frame legs 111, 112 with two upper ends of the side frame legs 132, 142 respectively. The pair of back upper frame joints 23, 24 are adapted for pivotally connecting two upper ends of the two back frame legs 122, 121 with two upper back ends of the side frame legs 131, 141 respectively. The pair of front lower frame joints 25, 26 are adapted for pivotally connecting two lower ends of the two front frame legs 112, 111 with two lower front ends of the side frame legs 131, 141 respectively. The pair of back lower frame joints 27, 28 with lower back ends of the side frame legs 132, 142 respectively.

The back frame 30 comprises a pair of back frame legs 31, 32 slidably penetrating through the two back upper frame joints 23, 24 respectively wherein two lower ends of the two back frame legs 31, 32 are respectively extended downwardly to pivotally connected to the two back lower frame joints 27, 28.

Figure 8:
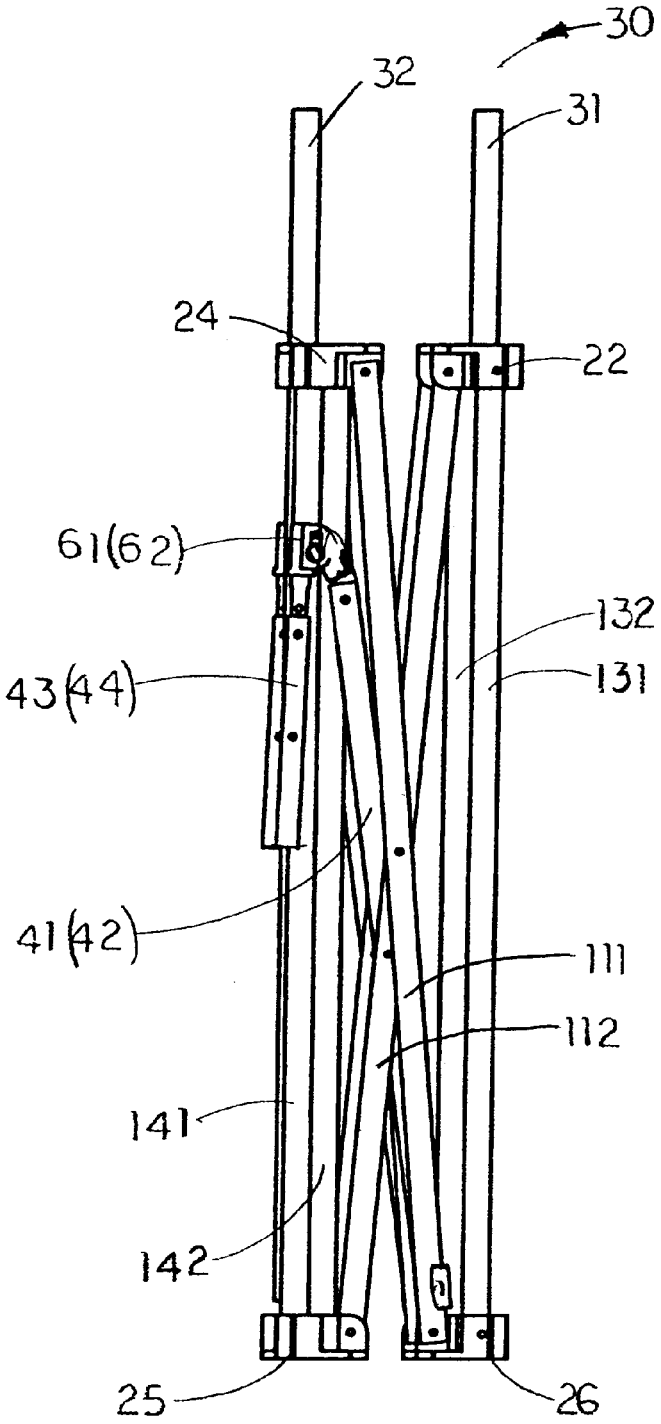
FIG. 8 is a front view of the foldable chair in a folded state according to the above preferred embodiment of the present invention.

As shown in FIGS. 2 and 3, the foldable chair further comprises a side desk frame 40 foldable and sidewardly extended from the seat frame 10 for supporting a desk fabric 1B thereon wherein the side desk frame 40 can be folded up when the seat frame 10 is folded up as shown in FIG. 8. The side desk frame 40 comprises a pair of supporting arms 41, 42 pivotally connecting with the second front and back frame legs 112, 122 respectively, a pair of slider joints 51, 52 for pivotally coupling two inner ends 411, 421 of the two supporting arms 41, 42 with the first front and back frame legs 111, 121, and a pair of pivot arms 43, 44, which are extending outwardly from the seat frame 10, pivotally coupling with two outer ends 412, 422 of the two supporting arms 41, 42 respectively.

According to the preferred embodiment, the two supporting arms 41, 42 are pivotally connected to lower portions of the second front and back frame legs 112,122 where they crossed respectively and the two inner ends 411, 421 of the two supporting arms 41, 42 are slidably connected to the lower portions of the first front and back frame legs 111,121 respectively.

Each slider joint 51, 52 comprises a slider body 511, 521 and a pivot wall 512, 522 integrally extended therefrom. The slider body 511, 521 has a slider hole 51 1A, 521A which has a diameter slightly larger than the respective first front and back frame legs 111, 121 and transversally extended through the slider body 511, 512 for the respective first front and back frame legs 111, 121 slidably passing through. The pivot walls 512, 522 of slider joints 51, 52 are pivotally connected to the inner ends 411, 421 of the supporting arms 41, 42.

The two pivot arms 43, 44 are pivotally coupling with the two outer ends 412, 422 of the two supporting arms 41, 42 by means of a pair of coupling joints 61, 62 respectively wherein the desk fabric 1B are adapted to be supported between the two pivot arms 43, 44.

Each coupling joints 61, 62 comprises a first joint member 611, 621 and a second joint member 612, 622 slidably connected each other wherein the first joint member 611, 621 is firmly affixed to the outer end 414, 422 of the respective supporting arm 41, 42 and the second joint member 612, 622 is firmly affixed to an inner end of the respective pivot arm 43, 44.

Each first joint member 611, 621 has a pair of pin-like protrusions 611A, 621A opposedly and outwardly extended from two sides thereof for slidably engaging with two sliding slots 612A, 622A provided on two side walls of the second joint member 612, 622. Each sliding slot 612A, 622A has an enlarged head portion 6121, 6221 and an elongated tail portion 6122, 6222 in such a manner that when the protrusions 611A, 621A are slidably moved to the head portion 6121, 6221 of the sliding slot 612A, 622A, the pivot arms 43, 44 are freely rotated about the outer ends 412, 422 of the supporting arms 41, 42 respectively, and when the protrusions 611A, 621A are slidably moved to the tail portion 6122, 6222 of the sliding slot 612A, 622A, the pivot arms 43, 44 are securely engaged with the supporting arms 41, 42 respectively in a vertical position, so as to vertically hold the pivot arms 43, 44 in position.

Figure 7:
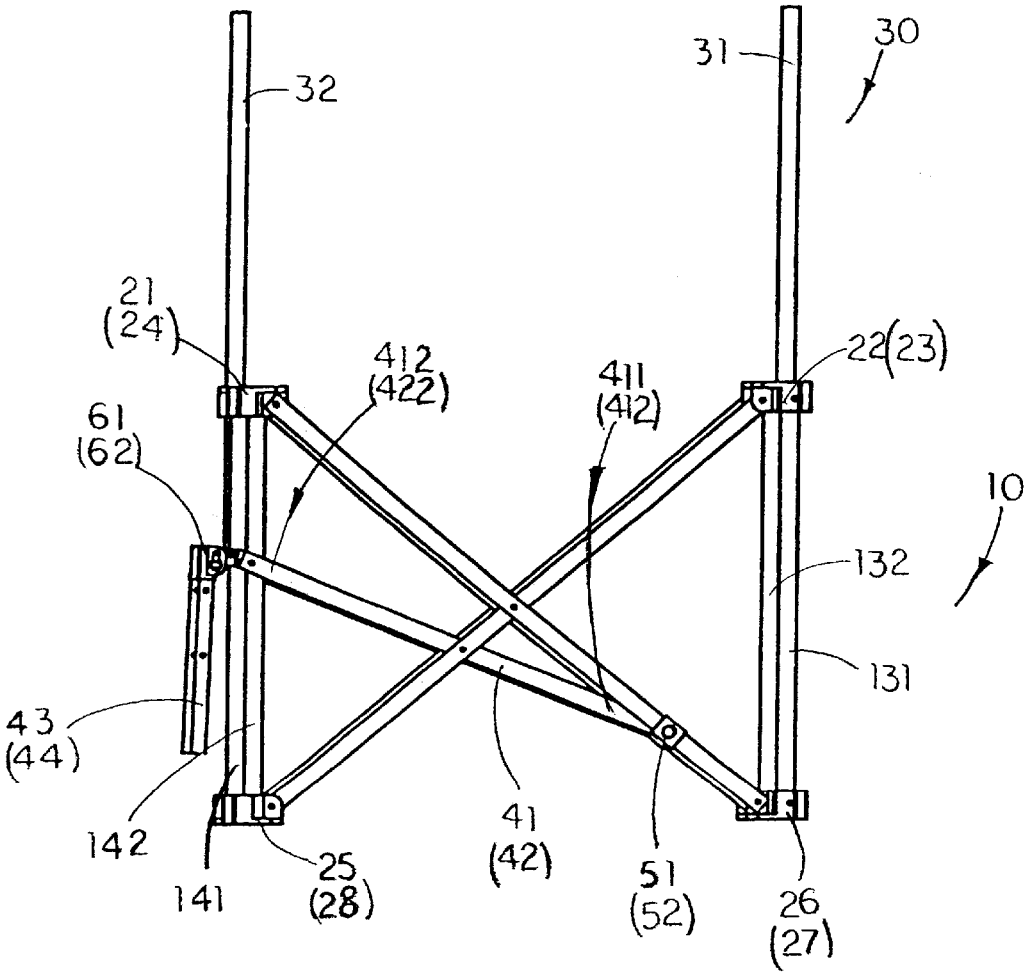
FIG. 7 is a rear view of the foldable chair according to the above preferred embodiment of the present invention, illustrating the folded support coupling means.

According to the preferred embodiment, each of the first joint members 611, 621 further has a top end wall 611B, 621B integrally extended from a ceiling of the first joint member 611, 621 so as to limit the rotation angle of the pivot arm 43, 44 when the protrusions 611A, 621A of the first joint member 611, 621 are slid into the head portion 6121, 6221 of the sliding slot 612A, 622A of the second joint member 612, 622. In other words, the pivot arms 43, 44 can only rotate in a downward movement, as shown in FIG. 7, and limit the upward rotation movement of the pivot arms 43, 44 by the top end wall 611B, 621B of the first joint members 611, 621 respectively. So, the user is able to fold up only the side desk frame 40 when it is not in use in order to save the space of the foldable chair.

Figure 9:
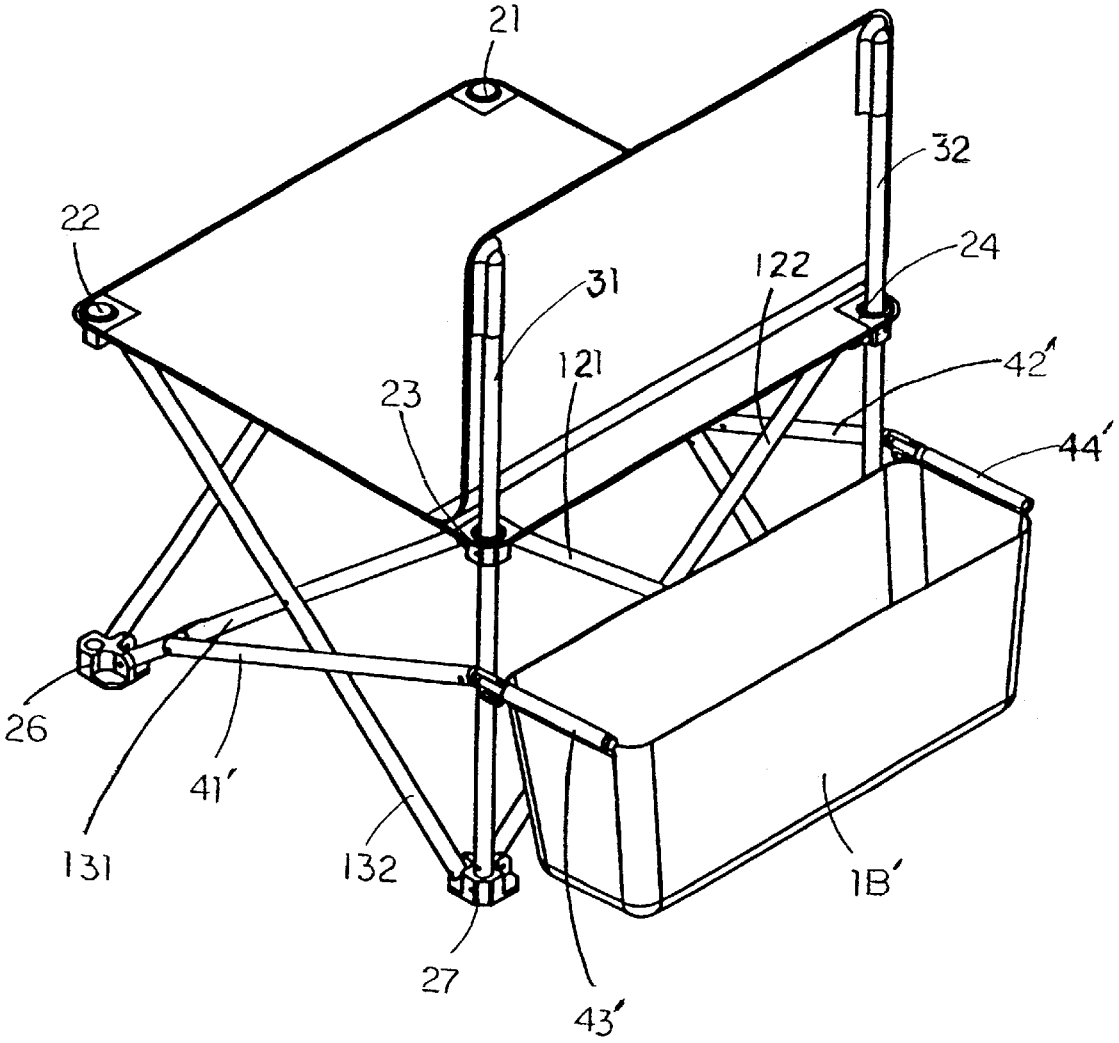
FIG. 9 illustrates a first alternative mode of the foldable chair according to the above preferred embodiment of the present invention, illustrating the foldable chair utilitized with a rear pocket.
Figure 10:
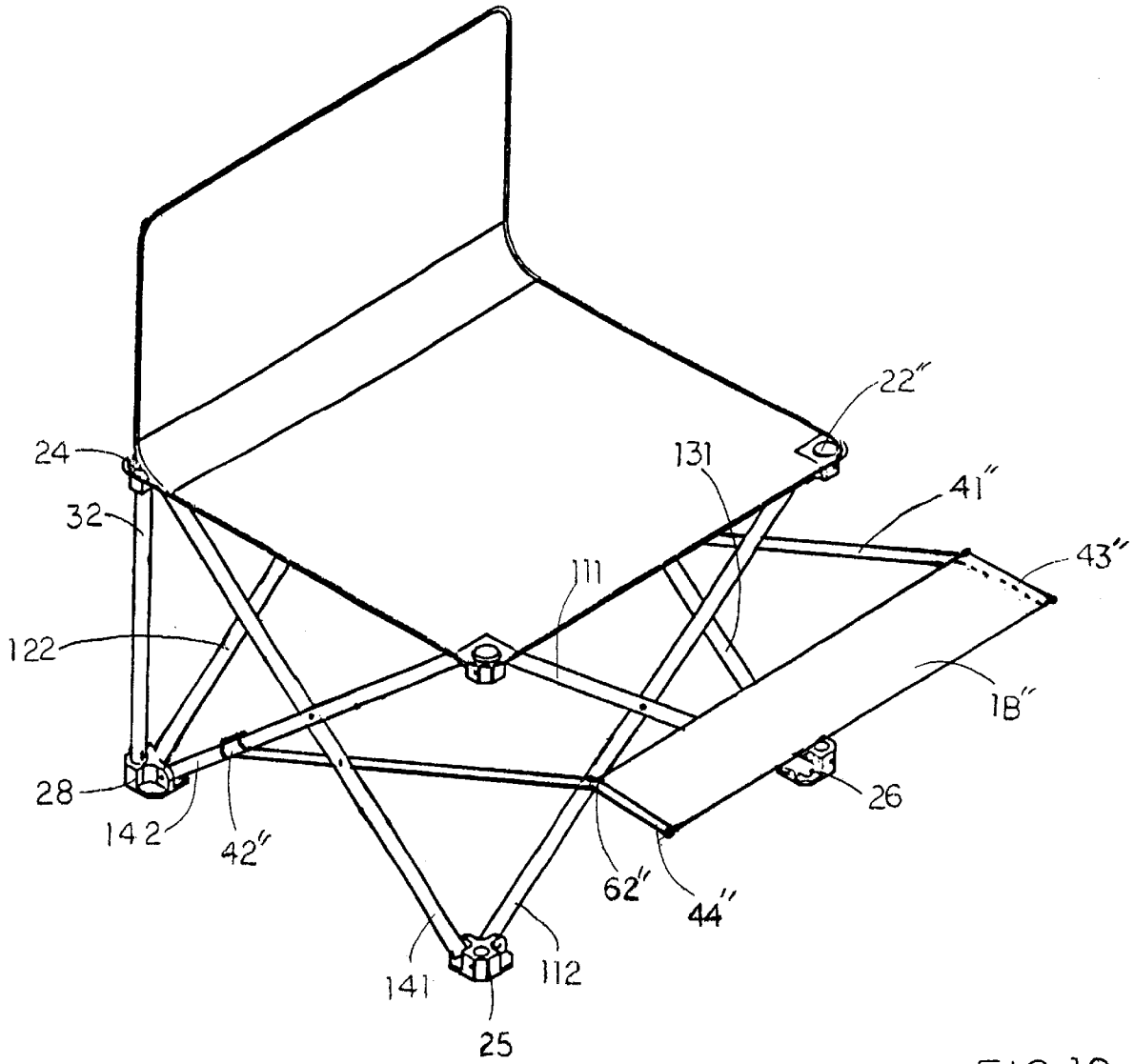
FIG. 10 illustrates a second alternative mode of the foldable chair according to the above preferred embodiment of the present invention, illustrating the foldable chair utilized with a leg rest support arrangement.

FIGS. 9 and 10 illustrate the modifications of the side desk frame 40 to function as a rear pocket frame 40' and a front leg rest support frame 40" without altering the original structure of the foldable chair, wherein the rear pocket frame 40' and the leg rest support frame 40" have the same structural design of the side desk frame 40.

Referring to FIG. 9, the rear pocket frame 40' is rearwardly extended from the seat frame 10 for supporting a pocket fabric 1B' thereon wherein the pocket frame 40' comprises a pair of supporting arms 41', 42' pivotally connecting with the second side frame legs 132', 142' respectively, a pair of slider joints 51', 52' for pivotally coupling two inner ends 411', 421' of the two supporting arms 41', 42' with the first side frame legs 131, 141, and a pair of pivot arms 43', 44', which are extending rearwardly from the seat frame 10, pivotally coupling with two outer ends 412', 422' of the two supporting arms 41', 42' respectively. So, the user is able to store his or her accessories such as magazines in the pocket fabric 1B' for convenience.

As shown in FIG. 10, the front leg rest support frame 40" is frontwardly extended from the seat frame 10 for supporting a leg rest fabric 1B" thereon wherein the leg support frame 40" comprises a pair of supporting arms 41", 42" pivotally connecting with the first side frame legs 131", 141" respectively, a pair of slider joints 51", 52" for pivotally coupling two inner ends 411', 421 ' of the two supporting arms 41', 42' with the second side frame legs 132, 142, and a pair of pivot arms 43", 44", which are extending rearwardly from the seat frame 10, pivotally coupling with two outer ends 412", 422" of the two supporting arms 41", 42" respectively.

It is worth to mention that since people trend to sit down with their legs bent, preferably, the pivot arm 43", 44" are inclinedly connected to the supporting arms 41", 42" in such a manner that the user's legs is capable of well supporting on the leg rest fabric 1B" naturally and comfortably.

What is claimed is:

1. A foldable chair comprising a seat frame constructed to support a fabric seat thereon and a side desk frame for supporting a desk fabric thereon foldably and sidewardly extended from said seat frame, wherein said seat frame comprises:

a pair of first and second front frame legs pivotally connected with each other in cross manner to form a "X" structure;

a pair of first and second back frame legs pivotally connected with each other in cross manner to form a "X" structure;

two pairs of side frame legs, each pair comprising a first side crossed leg and a second side crossed leg pivotally connected with each other in a cross manner to form a pivotal "X" structure;

a pair of front lower frame joints for pivotally connecting two lower ends of said two front frame legs with two lower front ends of said side frame legs respectively;

a pair of back lower frame joints for pivotally connecting two lower ends of said two back frame legs with two lower back ends of said side frame legs respectively;

a pair of front frame joints for pivotally connecting two upper ends of said two front frame legs with two upper front ends of said side frame legs respectively;

a pair of back upper frame joints for pivotally connecting two upper ends of said two back frame legs with two upper back ends of said side frame legs respectively; and said side desk frame comprising a pair of foldable supporting arms pivotally connecting with said second front and back frame legs respectively, a pair of slider joints for pivotally coupling two inner ends of said two supporting arms with said first front and back frame legs, and a pair of pivot arms which extend outwardly from said seat frame pivotally coupling with two outer ends of said two supporting arms respectively.

2. The foldable chair, as recited in claim 1, wherein each of said slider joint comprises a slider body and a pivot wall integrally extended therefrom, said slider body having a slider hole which has a diameter slightly larger than said respective first front and back frame legs and transversally extended through said slider body for said respective first front and back frame legs slidably passing through and said pivot walls of slider joints being pivotally connected to said inner ends of said supporting arms.

3. The foldable chair, as recited in claim 2, wherein said side desk frame further comprises a pair of coupling joints for coupling said two supporting arms with said two pivot arms respectively, each of said coupling joints comprising a first joint member and a second joint member slidably connected each other wherein said first joint member is firmly affixed to said outer end of said respective supporting arm and said second joint member is firmly affixed to an inner end of said respective pivot arm.

4. The foldable chair, as recited in claim 3, wherein each said first joint member has a pair of pin-like protrusions opposedly and outwardly extended from two sides thereof for slidably engaging with two sliding slots provided on two side walls of said second joint member.

5. The foldable chair, as recited in claim 4, wherein said sliding slot has an enlarged head portion and an elongated tail portion in such a manner that when said protrusions are slidably moved to said head portion of said sliding slot, said pivot arms are freely rotated about the outer ends of said supporting arms respectively, and when said protrusions are slidably moved to said tail portion of said sliding slot, said pivot arms are securely engaged with said supporting arms respectively in a vertical position, so as to vertically hold said pivot arms in position.

6. The foldable chair, as recited in claim 5, wherein each of said first joint members further has a top end wall integrally extended from a ceiling of said first joint member so as to limit said rotation angle of said pivot arm.

7. The foldable chair, as recited in claim 4, wherein each of said first joint members further has a top end wall integrally extended from a ceiling of said first joint member so as to limit said rotation angle of said pivot arm.

8. The foldable chair, as recited in claim 3, wherein each of said first joint members further has a top end wall integrally extended from a ceiling of said first joint member so as to limit said rotation angle of said pivot arm.

9. The foldable chair, as recited in claim 1, wherein said side desk frame further comprises a pair of coupling joints for coupling said two supporting arms with said two pivot arms respectively, each of said coupling joints comprising a first joint member and a second joint member slidably connected each other wherein said first joint member is firmly affixed to said outer end of said respective supporting arm and said second joint member is firmly affixed to an inner end of said respective pivot arm.

10. The foldable chair, as recited in claim 9, wherein each said first joint member has a pair of pin-like protrusions opposedly and outwardly extended from two sides thereof for slidably engaging with two sliding slots provided on two side walls of said second joint member.

11. The foldable chair, as recited in claim 10, wherein said sliding slot has an enlarged head portion and an elongated tail portion in such a manner that when said protrusions are slidably moved to said head portion of said sliding slot, said pivot arms are freely rotated about the outer ends of said supporting arms respectively, and when said protrusions are slidably moved to said tail portion of said sliding slot, said pivot arms are securely engaged with said supporting arms respectively in a vertical position, so as to vertically hold said pivot arms in position.

* * * * *